US006616897B1

(12) United States Patent
Lurz et al.

(10) Patent No.: US 6,616,897 B1
(45) Date of Patent: Sep. 9, 2003

(54) TEMPERING DEVICE FOR LABORATORY VESSELS

(75) Inventors: Werner Lurz, Kaltenkirchen (DE); Thomas Puttfarken, Tangstedt (DE); Klaus Schürbrock, Hamburg (DE)

(73) Assignee: Eppendorf AG, Hamburg (DE)

( * ) Notice: Subject to any disclaimer, the term of this patent is extended or adjusted under 35 U.S.C. 154(b) by 0 days.

(21) Appl. No.: 09/687,735

(22) Filed: Oct. 13, 2000

(30) Foreign Application Priority Data

Oct. 15, 1999 (DE) ..... 299 18 179

(51) Int. Cl.[7] ..... B01L 9/00

(52) U.S. Cl. ..... 422/104; 422/99; 422/102; 62/129; 62/389; 62/371

(58) Field of Search ..... 436/338; 62/129, 62/384, 371, 372, 440, 441; 422/104, 99, 102; 220/750, 751, 752, 755; 374/161, 162

(56) References Cited

U.S. PATENT DOCUMENTS 5,058,397 A * 10/1991 MacDonald ..... 62/457.2
5,501,945 A * 3/1996 Kanakkanatt ..... 430/338
6,361,746 B1 * 3/2002 Wlodarski ..... 422/104

* cited by examiner

*Primary Examiner*—Jill Warden
*Assistant Examiner*—Samuel P. Siefke
(74) *Attorney, Agent, or Firm*—Sidley Austin Brown & Wood, LLP

(57) ABSTRACT

A tempering device for laboratory vessels and having a liquid-tight housing formed, at least partially, of a plastic dyed with a heat sensitive dye and filled, at least partially, with a tempering medium, and further having depressions extending into the housing.

6 Claims, 1 Drawing Sheet

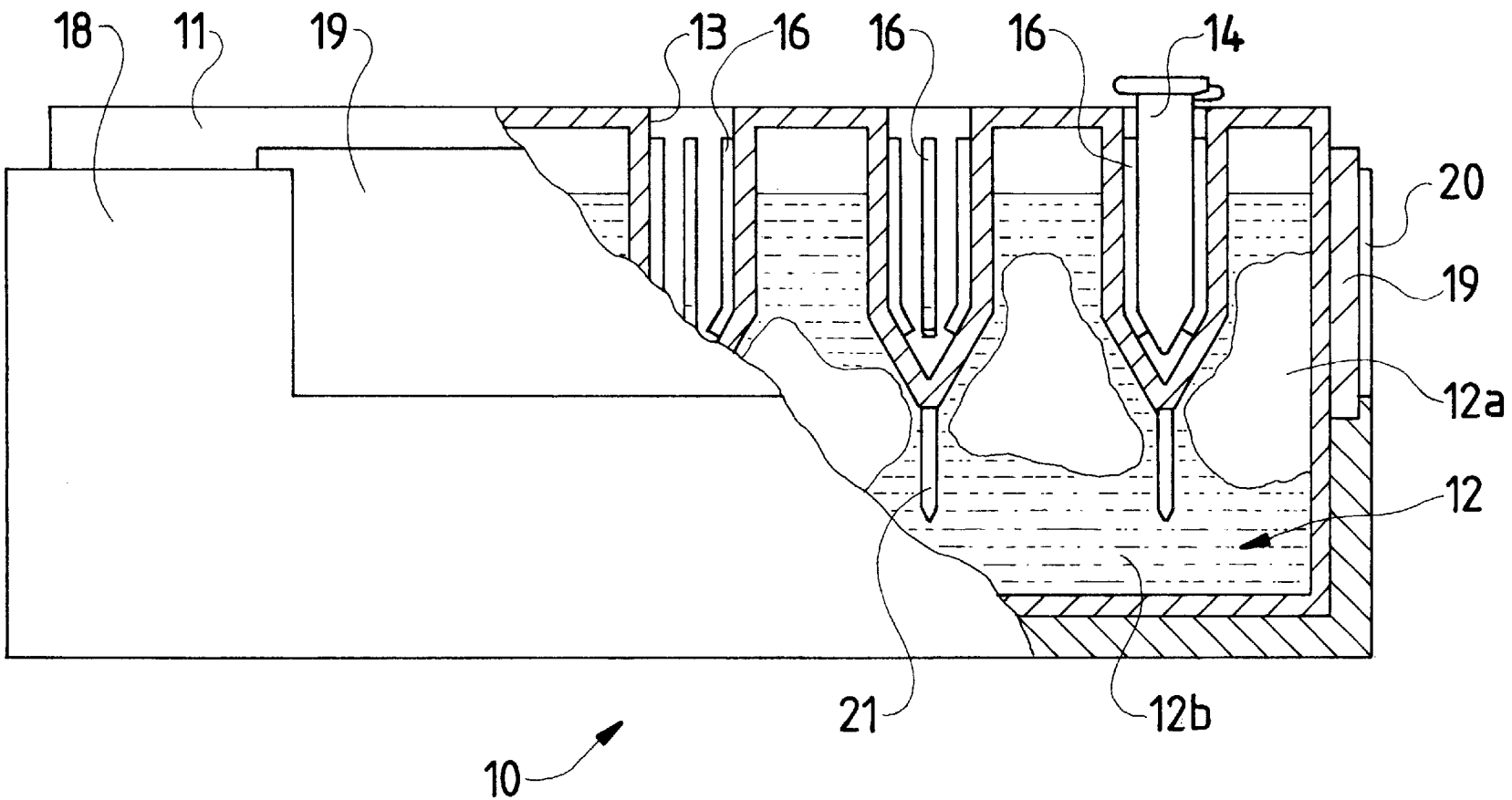
20
19
12a
12
14
16
16
16
13
19
11
18
12b
21
10

TEMPERING DEVICE FOR LABORATORY VESSELS

BACKGROUND OF THE INVENTION

1. Field of Invention

The present invention relates to a tempering device for laboratory vessels and including a liquid-tight housing filled at least partially with a tempering medium and in which inwardly pointing depressions are formed.

2. Description of the Prior Art

Generic tempering devices, which are also referred to as cooling accumulators or the like, are used to temper laboratory vessels, such as reaction vessels containing heat-sensitive liquid batches.

Generic tempering devices have a liquid-tight housing, which is filled at least partially with a tempering medium such as water. Before use, the tempering devices are heated or cooled and are then in a position to maintain the temperature within a certain range for a longer period of time (up to a few hours).

An example of a generic tempering device is disclosed, e.g., in German Utility Patent G 92 05 100.6. The device described here is used, for example, together with a holder, in which the reaction vessels are accommodated with their closed ends freely hanging downward. The housing of the tempering device has depressions to the number and arrangement of which correspond to the holes of the holder. In operation, the holder is disposed on the tempering device in such a manner, that the reaction vessels, which are accommodated in it, are inserted with their closed ends in the depressions of the tempering device. Independently of this, however, the reaction vessels can also be inserted directly, that is, without holders, in the tempering device.

A drawback of the known device consists in; that it is difficult to check whether or not the device still makes possible the desired tempering within the range of the required working temperatures.

Accordingly, it is an object of the present invention to provide a tempering device for laboratory vessels such that a user can easily check its temperature state.

SUMMARY OF THE INVENTION

This and other objects of the present invention, which will become apparent hereinafter, are achieved by forming the housing of the tempering device at least partially of a plastic dyed with a heat-sensitive dye.

Heat-sensitive dyes, which can be used to dye the housing or regions of the housing of the inventive tempering device, have been known for a long time. Usually, they can have two different colors, which depend on the temperature, with the color change taking place reproducibly in a temperature range, specific for a respective dye.

For the inventive tempering devices, which are to be used primarily for cooling purposes, especially those dyes are suitable, which change their color just above the freezing point, that is, in a range between 4° and 8° C. If a color change occurs during use, then this is an indication of the abating cooling performance of the tempering device.

The known heat-sensitive dyes are used already for a series of different applications. For example, there are plastic spoons, which are included in packages of cornflakes and change their color depending on the temperature. Further applications are to be found in the fashion jewelry sector. However, until now, the use of heat-sensitive dyes remained limited to everyday objects or the advertising sector. Uses in the research area or in the laboratory area are not known.

It is conceivable that individual, well recognizable regions of the housing of the inventive tempering device are dyed with heat-sensitive plastic. However, it is also, of course, possible to produce the whole housing of a plastic, appropriately dyed with a heat-sensitive die. The manufacture may take place in the usual manner, for example, by injection molding.

The inventive tempering device offers a series of advantages. It is an important advantage that the user be informed in a clearly recognizable manner, for example, of the abating cooling performance of the tempering device and optionally, in the case of an appropriate configuration, even receives individual information concerning the temperature of individual laboratory vessels placed in the device.

All the usual media, suitable for tempering, can be used in the inventive tempering device. Advantageously, the phase transition of a tempering medium, contained in the tempering device is utilized for the tempering. For example, it is conceivable to provide a medium based on water and ice or the like, which is suitable for tempering low temperatures (cooling effect). Tempering devices with such cooling media are cooled before use up to solidification. During use, the medium is heated relatively rapidly up to its melting temperature and then maintains this value. A constant cooling effect is achieved in the region of the melting temperature of the tempering medium, which decreases with increasing conversion to the liquid phase.

It is, of course, also possible to provide other tempering media, especially those, which make a constant temperature possible in the physiologically interesting region between 25° C. and 37° C. Here also, media can be used once again, the solidification or melting temperature of which corresponds to the desired working temperature. In this case, the tempering elements are heated before use to a temperature above their melting temperature. During use, the tempering medium changes from a liquid to a solid aggregate state, this process extending over a longer period of time, in which the stored energy is given off slowly and uniformly and the temperature remains stable (in the region of the solidification temperature).

In both cases, the duration of the tempering effect depends primarily on the insulation of the tempering device from its environment. In the case of the inventive tempering device, it is a further problem that the housing, and the heat-sensitively dyed regions contained therein, have direct contact with its surrounding environment, unless other provisions are made. The danger therefore exists that a change in color of the regions occurs, which is produced by the temperature of the surrounding environment and does not correspond to the actual cooling state of the device and, especially, not to the actual cooling state of interest in the depressions. In this connection, a particularly preferred development provides that only the wall regions, adjoining the depressions, are produced from the heat-sensitive plastic or, since such a production is relatively expensive, in the case of a housing consisting, as a whole, of heat-sensitive plastic, a cover, covering or insulating at least its upper surface, is provided, which has a window assigned to the depressions. In the case of this development of the housing, the actually interesting information, namely, the temperature state in the depressions, can be recognized particularly easily.

According to a further advantageous development of the invention, the housing is thermally insulated from the outside. The insulation may be transparent as a whole. It is, however, also possible to make the insulation opaque and to provide a window in the insulation, which is assigned to the selected regions of the housing, as described, for example, above.

In this connection, it would be conceivable, for example, that the tempering device is accommodated in a further insulated housing, which is open at one side and inverted before use over the pre-tempered device. Equally well however, it would also be conceivable to provide thermally insulating coatings or components at the outer regions of the housing. For example, it would be conceivable to dispose pockets at the outside of the housing, into which the optionally transparent plastic plates with insulating properties can be inserted.

As stated above, a significant advantage of the inventive tempering device consists in that, by a change in color of the heat-sensitive region or regions of the housing, it is possible to check rapidly and in a simple manner whether the temperature state of the device is still in the desired working temperature range.

Advantageously, the tempering medium and the heat-sensitive plastic, used to produce the inventive tempering device, should be coordinated to the desired tempering range. The tempering medium should be selected so that, after an appropriate pretreatment, a temperature in the region of the desired working temperature range is maintained over a long period of time. The heat sensitive plastic, on the other hand, should be selected so that its changeover temperature is somewhat below or above the desired working temperature region, depending on whether the tempering device heats up or cools off during the work due to the temperature of the surroundings.

Aside from an indication concerning the general temperature state of the device, it is, however, also of interest to know the temperature of the individual laboratory vessels, tempered by the device. For example, it is conceivable that vessels with different initial temperatures are inserted into the tempering device, after which they are to follow a common further processing only when all the vessels have been cooled down, for example, to the desired working temperature range.

For these or similar cases, according to the invention the depressions of the tempering device are provided with protruding regions, which are dyed with a heat sensitive dye and are in direct thermal contact with the inserted laboratory vessels. Because of their distance from the remaining wall regions of the depression, which are in direct contact with the tempering medium and therefore do not change color as rapidly, these regions, which may be constructed, for example, in the form of protruding ribs, are in a position to indicate individually the temperature of the inserted laboratory vessels and permit a rapid conclusion to be drawn concerning the progress of a cooling or heating process. In addition, ribs, for example, represent a guidance for the vessels and, because of the reduced heat transfer, can prevent the freezing of the contents of vessels in the depressions.

BRIEF DESCRIPTION OF THE DRAWINGS

The objects and advantages of the present invention will become more apparent and the invention itself will be best understood from the following detail description of the preferred embodiment when read with reference to the accompanied drawings, wherein:

Single FIGURE shows a partially cross sectional view of the tempering device according to the present invention.

DETAILED DESCRIPTION OF THE PREFERRED EMBODIMENT

The inventive tempering device 10 has a liquid-tight housing 11, which is filled with a tempering medium 12. The tempering medium is partially in the solidified state 12*a* and partially in the liquid state 12*b*. In the Figure, the housing 11 is filled only partially with tempering medium 12, in order to allow space for the expansion during freezing. In this regard, it would also be conceivable to provide a compressible material in the interior of the housing 11 and to fill the remaining space completely with tempering medium.

During use, the tempering device 10 approximately maintains the temperature at which the tempering medium 12 changes over from the solid phase to the liquid phase.

In the housing 11 of the tempering device 10, there are provided depressions 13 which serve as seats for the reaction vessels 14 that are to be tempered. It is self-evident that the depressions can also be constructed differently, for example, so that tempering of laboratory vessels of different shape or also of microtiter plates is possible.

In the embodiment shown in the drawing, the housing 11 is produced as a whole from a plastic dyed with a heat-sensitive dye.

In order to ensure that the housing does not adapt too rapidly to the temperature of the surroundings, advantageously at least partially transparent insulation 18 is provided, which thermally insulates a significant region of the housing towards the outside. In the embodiment shown, windows 19, through which the adjoining outer wall of the housing can be observed, are inserted in holders 20 in the insulation 18. Furthermore, an optionally insulating cover of the upper surface of the housing, which only leaves the depressions 13 free, would also be conceivable. Such a cover would improve the insulation and would have the additional advantage that the user can perceive a change in color only in the depressions 13, that is, in the region of interest.

Furthermore, ribs 16 in the depressions 13 are also formed of a plastic dyed with a heat-sensitive dye. The ribs 16 contact the wall of the inserted vessel 14 and their color changes, as a function of the temperature of the vessel. In addition to an indication of the temperature state of the housing 11, which is obtained by the change in color, individual information concerning the temperature of the vessels can also be obtained in this way.

Moreover, the ribs 16 prevent the vessel 14 from freezing to the depressions 13. On the other hand, the tempering performance is decreased since the vessels 14 are contacted only by the ribs 16.

Furthermore, projections 21, which extend from the depressions 13 into the interior of the housing 11, are intended to ensure heat conduction between the depressions 13 and the tempering medium 12. This is done to ensure that all depressions 13 are tempered as uniformly as possible.

Though the present invention was shown and described with references to the preferred embodiment, such are merely illustrative of the present invention and are not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A tempering device for tempered treatment of liquid samples in laboratory vessels, comprising a liquid-tight housing filled at least partially with a tempering medium; and inwardly pointing depressions provided in the housing and serving as seats for the to-be-tempered laboratory vessels, said depressions having ribs which protrude into an interior space of the depressions for contacting walls of the laboratory vessels , and are formed from a plastic dyed with a heat-sensitive dye having a change-over temperature at a predetermined value.

2. A tempering device of claim 1, wherein the housing is formed at least partially of a plastic dyed with a heat-sensitive dye having a change-over temperature at a predetermined value.

3. The tempering devices of claim 1, wherein the housing essentially has the shape of a cuboid, and wherein the depressions are formed on one side of the cuboid.

4. The tempering device of claim 3, wherein a side of the housing, carrying the depressions, is so formed with respect to the number, arrangement and configuration of the depressions that conventional microttier plates can be tempered with the tempering device.

5. The tempering device of claim 1, wherein the housing is provided at least partially with thermal insulation.

6. The tempering device of claim 1, wherein the housing has an upper region, which contains the depressions and is formed of a plastic dyed with a heat-sensitive dye, and wherein the device further comprises a covering for the upper region and which has boreholes associated with the depressions.

* * * * *